US009044969B2

(12) United States Patent
Roof et al.

(10) Patent No.: US 9,044,969 B2
(45) **Date of Patent: *Jun. 2, 2015**

(54) METHODS, APPARATUS, AND SYSTEMS FOR UV GEL INK SPREADING

(75) Inventors: Bryan J. Roof, Newark, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 887 days.

This patent is subject to a terminal disclaimer.

(21) Appl. No.: 13/160,120

(22) Filed: Jun. 14, 2011

(65) Prior Publication Data

US 2012/0320117 A1 Dec. 20, 2012

(51) Int. Cl.

| | |
|---|---|
| ***B41J 29/393*** | (2006.01) |
| ***B41J 2/125*** | (2006.01) |
| ***B41J 11/00*** | (2006.01) |
| ***B41M 7/00*** | (2006.01) |

(52) U.S. Cl.

CPC ..... *B41J 11/002* (2013.01); *B41M 7/0081* (2013.01)

(58) Field of Classification Search

CPC ..... B41J 2/04501; B41J 11/002; B41J 2002/16564; B41J 2/475; B41J 29/393; B41J 2/17546; B41M 5/52; B41M 5/5218; B41M 5/5209

USPC ..... 347/102, 105, 19, 99, 101

See application file for complete search history.

(56) References Cited

U.S. PATENT DOCUMENTS

| | | | | |
|---|---|---|---|---|
| 4,971,408 | A * | 11/1990 | Hoisington et al. | 347/102 |
| 5,105,204 | A * | 4/1992 | Hoisington et al. | 347/105 |
| 6,336,720 | B1 * | 1/2002 | Suzuki et al. | 347/88 |
| 7,316,474 | B2 * | 1/2008 | Tatsumi et al. | 347/101 |
| 8,272,730 | B2 * | 9/2012 | Hori | 347/102 |
| 8,628,177 | B2 * | 1/2014 | Barton et al. | 347/84 |
| 2004/0095451 | A1 * | 5/2004 | Tatsumi et al. | 347/101 |
| 2005/0073542 | A1 * | 4/2005 | Yoneyama | 347/15 |
| 2008/0291255 | A1 * | 11/2008 | Poxon | 347/103 |
| 2009/0135239 | A1 * | 5/2009 | Chretien et al. | 347/102 |
| 2009/0322811 | A1 * | 12/2009 | Higgins et al. | 347/9 |
| 2010/0177151 | A1 * | 7/2010 | Thompson et al. | 347/102 |
| 2010/0265292 | A1 * | 10/2010 | Ohshima et al. | 347/16 |
| 2011/0148973 | A1 * | 6/2011 | Chappell et al. | 347/18 |
| 2012/0281049 | A1 * | 11/2012 | Kachi | 347/102 |

* cited by examiner

*Primary Examiner* — Matthew Luu
*Assistant Examiner* — Patrick King
(74) *Attorney, Agent, or Firm* — Ronald E. Prass, Jr.; Prass LLP

(57) ABSTRACT

A UV curable gel ink spreading method and system includes setting an ink re-flow drum temperature, jetting UV gel ink onto a substrate using a print head, heating a back side of the substrate to cause re-flow using the re-flow drum, and curing the UV gel ink image using a UV source to produce a cured image. At least one of drawback and line spread may be measured in-line to determine whether to modify a drum temperature, a UV source location, and/or a print process speed to optimize drawback and/or line spread. Acceptable or optimized temperatures and/or UV source locations may be saved as a set point that corresponds to a substrate type.

19 Claims, 6 Drawing Sheets

METHODS, APPARATUS, AND SYSTEMS FOR UV GEL INK SPREADING

FIELD OF DISCLOSURE

The disclosure relates to methods, apparatus, and systems for Ultra-Violet (UV) curable gel ink spreading. In particular, the disclosure relates to methods, apparatus, and systems for setting backside re-flow temperature, UV source location, and process speed in UV gel ink digital printing processes.

BACKGROUND

UV curable gel inks are advantageous over conventional liquid inks at least because they tend to form drops having less mobility than those formed by conventional inks. When UV gel inks are jetted onto a substrate to form an image, the ink drops are liquid. The drops are quickly quenched to a gel state upon contacting the substrate on which the image is formed, and therefore have limited mobility.

Conventional inks tend to form mobile liquid drops upon contact with a substrate. As such, substrates are typically coated and/or treated to prevent, e.g., coalescence of mobile liquid ink drops. For example, a paper substrate for use with conventional inks may be coated with materials that increase adhesion characteristics and increase surface energy, or otherwise affect chemical interaction between the paper substrate and inks. Such coatings or treatments require special operations to apply to the media, and additional cost is associated with their use. A printing process using digital presses and conventional presses may require different media supplies suitable for each press. UV gel inks are desirable at least because they exhibit superior drop positioning on a variety of substrate types, regardless of how the substrates are treated. It is cost advantageous, for example, to run the same media or substrate type across multiple printing apparatuses and not to have to carry, for example, specially coated stock.

SUMMARY

It has been found that UV gel ink processes may benefit from methods, apparatus, and systems for achieving adequate spread of jetted ink or ink lines to address problems including image artifacts caused by, e.g., objectionable pile heights. Methods, apparatus, and systems accommodate adequate line spread, and cost effective printing processes, among other advantages. For example, a back side of a media web or substrate may be heated to a temperature that causes re-flow of jetted UV gel ink. A position of a UV source, e.g., a cure lamp, may be adjusted to modify dwell. Further, a process speed may be adjusted, alone or in combination with one or more of adjusting a UV source position and applying heat a back side of the substrate.

Backside re-flow may be used in conjunction with a UV radiation source to level and then cure jetted gel ink before drawback occurs by setting a re-flow member temperature and/or UV source location. An amount of heat transferred through a back side of a substrate may vary as a function of thermal properties of a substrate and substrate thickness. As such, an optimal temperature set point may be determined for each substrate type, by trial and error and/or knowledge of thermal characteristics. A temperature setpoint may be stored per substrate type, and when a UV gel ink process is run, the temperature setpoint may be used to automatically adjust the re-flow member temperature. An in-line image analysis may be performed using, e.g., an in-line sensor and/or imaging system configured to measure drawback of a known target.

The re-flow member temperature, UV source location, and/or print process speed may be adjusted based on the results of the in-line image analysis.

Adjusting a re-flow member temperature may be time consuming due to heating/cooling rates of a potentially significant thermal mass, particularly for systems incorporating a large drum as a re-flow member. To enhance an efficiency of determining optimizing temperature setpoints for particular substrates and accommodate gel ink spreading as desired, a UV source location may be adjusted to modify the dwell. A combination of re-flow member temperature adjustment and UV source location adjustment may be used to set dwell between re-flow and cure for particular substrates. Further, a process speed adjustment wherein a speed of the printing process is adjusted may be used alone or in combination with a re-flow member temperature adjustment and a UV source location adjustment to modify and set dwell between re-flow and cure.

Methods in accordance with an embodiment include setting a re-flow member temperature; jetting UV gel ink onto a substrate; heating a back side of the substrate whereby the jetted UV gel ink re-flows; and curing the UV gel ink. For example, a re-flow member temperature may be set to 200° C. Methods may include adjusting the re-flow member temperature to a temperature setpoint, which may correspond to a particular substrate type, and which may be determined by running a calibration process.

In another embodiment, methods may include measuring a drawback; analyzing a drawback measurement; and saving a re-flow member temperature setpoint if drawback is acceptable, or adjusting a re-flow member temperature setpoint if drawback is not acceptable. A temperature of the re-flow member may be decreased or increased.

In an embodiment, methods may include measuring a line spread. For example, line spread may be measured by sensing jetted and spread ink using an in-line sensor configured to product line spread data. The in-line sensor may be or may form an in-line imaging system. In another embodiment, drawback may also be measured using an in-line sensor. For example, methods in accordance with an embodiment may include measuring a drawback; sensing the jetted and spread ink using an inline sensor to produce drawback data; analyzing drawback data to determine whether the drawback is within a target value or range; analyzing the line spread data to determine whether the line spread is within target value or range; saving a re-flow member temperature setpoint if the drawback is within the drawback target value or range, if the line spread is equal to the line spread target value or range; and adjusting a re-flow member temperature if at least one of the drawback and the line spread are outside of the target values or target ranges.

For example, the re-flow member temperature may be decreased if the line spread is outside of the target value or target range. The re-flow member temperature may be increased if the drawback is outside of the target value or range. In an embodiment, the re-flow member temperature may be adjusted if the drawback and/or line spread are outside of a UV source adjustment range. For example, if the drawback is outside of a target value or range, but within a UV source adjustment range, the UV source may be moved closer to a re-flow zone. If the line spread is outside of a target value or range, but within a UV source adjustment range, then the UV source may be moved away from a re-flow zone.

In another embodiment, a speed of the print process may be adjusted. Specifically, the print process may be adjusted so that a speed of the print process is increased. Increasing the print process speed may decrease an amount of time that a substrate carrying a gel ink image is heated by the re-flow member. Decreasing the print process speed may increase an amount of time that the back side of the substrate is subject to heating by the re-flow member. For example, heat transfer properties of a substrate such as card stock may require that a process speed be decreased to allow for adequate heat transfer and accommodate re-flow. Adjusting a print process speed may be performed alone or in combination with adjusting a re-flow member temperature and/or adjusting a UV source location.

Apparatus in accordance with an embodiment may include a UV gel ink spreading apparatus, comprising a UV gel ink print head; a temperature controlled heated re-flow member for spreading gel ink deposited on a substrate, such as a media web, by the UV gel ink print head; and a sensor. In another embodiment, apparatus may comprise a controller that sets a temperature of the re-flow member based on at least one of a plurality of temperature setpoints that each corresponds to a substrate type, the setpoints being defined by optimizing at least one of a UV source location, the re-flow member temperature, and a print process speed based on data produced by the sensor. In another embodiment, apparatus may include a UV source for curing the UV gel ink, which is deposited by the print head and spread by the re-flow member. The UV source may be movable based on data produced by the sensor. In an embodiment, a print process speed may be adjusted to increase or decrease the print process speed, and modify dwell or set the amount of time that a substrate carrying jetted gel ink is in a re-flow zone.

Systems in accordance with an embodiment may include a UV gel ink spreading system, comprising a print head that deposits UV gel ink on a substrate; a temperature controlled, heated re-flow member that spreads the UV gel ink on the substrate at a re-flow zone; at least one sensor that senses the spread UV gel ink, and that generates data for analyzing line spread and/or drawback of the UV gel ink deposited by the print head; a controller that adjusts a temperature of the re-flow member based on the data generated by the sensor; and a storage unit that stores a temperature set point based on data generated by the sensor, and the temperature setpoint corresponding to a substrate type. In another embodiment, systems may include a UV source that cures the UV gel ink, which is jetted by the print head and spread by the heated re-flow member, the UV source being movable with respect to a re-flow zone. The UV source may be movable based on the data produced by the sensor. In another embodiment, a print process speed adjustment system may be increase or decrease a print process speed based on the data generated by the sensor.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
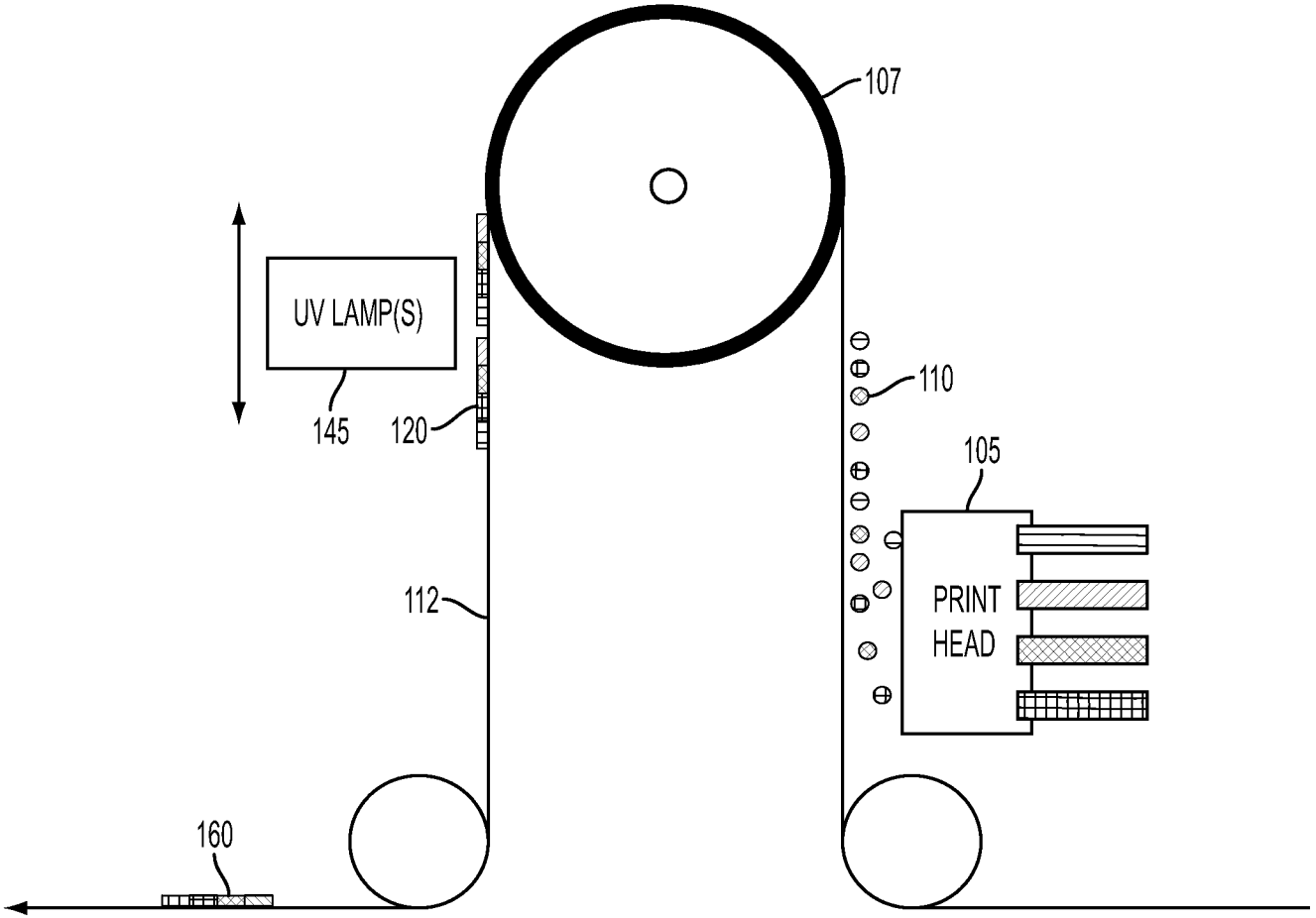
FIG. 1 shows a diagrammatical side view of a UV gel ink spreading apparatus and system in accordance with an exemplary embodiment.

Exemplary embodiments are intended to cover all alternatives, modifications, and equivalents as may be included within the spirit and scope of the apparatus and systems as described herein.

Reference is made to the drawings to accommodate understanding of methods, apparatus, and systems for UV gel ink spreading. In the drawings, like reference numerals are used throughout to designate similar or identical elements. The drawings depict various embodiments and data related to embodiments of illustrative methods, apparatus, and systems for UV gel ink spreading according to substrate type.

To produce an acceptable digitally printed gel ink image using an ink jet print head configured to jet ink directly onto a substrate such as a media web, a pile height of jetted ink droplets may be monitored and analyzed. Observations of pile heights with respect to particular substrate types, e.g., paper media web of specific thicknesses, may be used to adjust system parameters to minimize image artifacts caused by, e.g., uneven pile heights of ink droplets, or a corduroy-like appearance formed by adjacent jetted ink lines of uneven or unacceptable pile height.

Parameters that may be adjusted include a temperature of a heated re-flow member that directly contacts and heats a back side of a substrate, which conducts heat to gel ink of a gel ink image jetted on an opposite, image-bearing, or front side of the substrate. The heated re-flow member applies heat to a back side of a substrate such as a media web at a re-flow zone, which substantially corresponds to a portion of the re-flow member that contacts and/or conducts heat to the back side of the web, which may be entrained by the re-flow member. As the media web pass through the re-flow zone in a process direction, the applied heat may conducted through the substrate to soften the jetted ink, causing the ink to melt and spread. As the ink cures, the spread ink may drawback.

Spread and drawback may be observed and/or measured. For example, an in-line sensor and/or imaging system may be used to observe one or more lines of jetted ink drops, and to measure characteristics such as an amount of line spread, and/or an amount of drawback. A particular amount or degree of line spread and/or drawback may be determined to correspond with an acceptable amount and/or elimination of image artifacts cause by, e.g., objectionable pile heights.

In addition to adjusting a temperature of a contact surface of a heated re-flow member, other UV gel ink printing system parameters may be adjusted to determine and optimize substrate type setpoints at which optimal ink line characteristics may be achieved. For example, a location of a UV source may be adjusted to affect dwell, and/or a print process speed may be adjusted. This may be done for various substrates and/or gel inks to calibrate a gel ink printing system for one or more substrate types, and/or develop a database of setpoints that may be used to automatically adjust system parameters based on a type of substrate used in a print process to ensure an acceptable digital gel ink image print on the substrate.

An embodiment of methods and systems includes adjusting a re-flow member temperature for a back side UV gel ink re-flow process to spread jetted UV gel ink by way of thermal re-flow caused by contact heating a back side of a substrate with a re-flow member. The UV gel ink, which is jetted on a side of the substrate that is opposite from the back side, e.g., a front side of the substrate, absorbs thermal energy that transfers through the substrate from the re-flow member. The re-flow member may be a heated drum. After the ink re-flows, UV radiation may be applied to cure and/or fix the UV gel ink image. For example, the UV gel ink may be cured partially for subsequent fixing and/or curing processes, or the UV gel ink may be cured substantially completely to produce a final cured gel ink image. The UV gel ink image may be cured so that any amount of ink that forms the image is caused to polymerize by way of the UV radiation, whether the amount of polymerized ink is small, or the amount of polymerized ink is more than substantial such that the image is finally cured.

Because an amount of heat transferred by the re-flow member through a backside of the media web or substrate may vary as a function of, e.g., thermal properties and thickness of the media, a drum temperature may be adjusted to achieve a desired and/or acceptable line spread and/or drawback by a re-flow process for specific substrate types. Acceptable temperatures for corresponding substrate types may be saved as setpoints for use in digital print processes. The setpoints may be determined by calibration processes, and/or may be modified by processes. For example, an embodiment of systems may include a sensor such as an imaging system for observing and/or measuring line spread and/or drawback for a target substrate to determine and optimize re-flow member temperature setpoints for the substrate. In an embodiment of systems and methods, a temperature of the re-flow member may be adjusted automatically with respect to particular substrates onto which UV gel ink will be jetted for curing, based on determined and saved setpoints.

To enhance optimization of a UV gel ink re-flow process, e.g., to shorten an amount of time required to find an optimal re-flow member temperature setpoint and/or dwell between a re-flow zone or a start of a re-flow zone, and a cure zone for a particular substrate, a UV source location may be adjusted. A location of a UV source for curing UV curable gel ink, such as a UV lamp, may be adjusted to balance line growth or spreading and drawback of re-flowed gel ink. In an embodiment, the location of the lamp may be automatically adjusted to a location that balances line growth and drawback by moving a location of the UV source with respect to a re-flow member to change an amount of time between a start of re-flow and ink polymerization during a print process. The location of the UV source may be moved closer to or further from the re-flow zone, or a portion thereof.

In another embodiment, the UV source may be adjusted if the UV source is within an adjustable range that is predetermined or known to be generally effective for stopping re-flow of jetted gel ink such that a desired drawback is achieved. For example, minimal or substantially no drawback is preferred. Further, the adjustable range may be a range of UV source positions known or generally understood to stop re-flow of jetted gel ink such that a desired and/or acceptable line spread, or degree of spreading of jetted gel ink drops and/or lines, is achieved.

If changing a location of the UV source is predetermined or known not to be effective in improving a line spread or drawback of jetted gel ink, methods include changing a re-flow member temperature, running another print process using the changed re-flow temperature, performing an analysis of line spread and/or drawback. For example, if changing a position of the a UV lamp in a UV curable gel ink printing system would effect only a nominal change in gel ink line characteristics, then the system may be configured to proceed to modify a re-flow member temperature. The process may be repeated until a target line spread and/or drawback is achieved.

In another embodiment, UV gel ink printing systems and spreading apparatus may include a process speed adjustment system for adjusting a process speed. For example, a process speed adjustment system for a web substrate printing system may be configured to adjust a speed of web translation. If process speed is increased, a time between jetting UV curable gel ink on a substrate to form an image, and arrival of the image at a re-flow zone may be decreased by increasing a speed at which the web translates. If a process speed is decreased, a time between jetting UV curable gel ink on a substrate to form an image, and arrival of the image at a re-flow zone may be increased by decreasing a speed at which the web substrate translates in a process direction during the print process.

FIG. 1 shows an embodiment of UV curable gel ink spreading apparatus and UV gel ink jetting, spreading, and curing systems. Specifically, FIG. 1 shows a UV gel ink system having a print head 105 for jetting UV curable gel ink, and a re-flow member 107. The printhead 105 may be configured, e.g., to jet or deposit UV curable gel ink onto a substrate to form a digitally printed gel ink image. The substrate may be a media web 112, which may be entrained about the re-flow member 107. The print head 105 may be configured to contain and/or deposit one or more inks, which may be clear, black, magenta, cyan, yellow or any other desired ink color.

The re-flow member 107 may be heated. For example, the re-flow member may be temperature controlled, and a surface of the re-flow member that contacts a substrate may be heated. The re-flow member 107 may be a drum of medium mass, such as an 8 mm aluminum drum having an anodized, Teflon impregnated contact surface. The drum may be configured to be rotatable about a central longitudinal axis. The web 112 may be extend to wrap around the re-flow member 107 so that a back side of the web 112 contacts the surface of the re-flow member 107, as shown.

A print head 105 may form a UV gel ink image 110 by jetting UV gel ink directly onto the web 112. The web 112 may be entrained by one or more rolls, and, e.g., the re-flow member 107. The UV gel ink image 110 may be carried to the re-flow member 107 by the web 112. For example, the image 110 may be carried to a re-flow zone for spreading the ink of the image 110. At the re-flow zone, the web 112 may adjacent to or contacting the re-flow member 107. The re-flow member 107 may be heated for applying heat to a back side of the web 112. As the re-flow member 107 applies heat to a back side of the web 112, thermal energy may be conducted through the web 112, to the UV gel ink, thereby causing the ink of the UV gel ink image 110 to re-flow.

A UV radiation source 145 may be arranged near a re-flow zone, and may define a cure zone at which ink may be subject to UV radiation. The UV radiation source 145 may be configured to irradiate the UV gel ink image 110 while and/or after the image 110 is spread and/or leveled by heated re-flow member 107. Thus, by contact with the re-flow member 107 and by subsequent heat transfer, a viscosity of the ink may lowered, enabling the ink to spread, at which time UV radiation may be applied to the ink to reduce mobility of the ink. For example, the ink may be spread by a re-flow process, and cured before drawback. Alternatively, the ink may be spread by a re-flow process and cured during drawback. The ink may be cured to minimize, or preferably eliminate drawback. In an embodiment, the ink may be cured so that an amount of the ink is polymerized. For example, the ink may be minimally cured, to be finally cured in a subsequent process. In another embodiment, the ink may be substantially cured so that a substantially amount of ink in the ink image 110 is polymerized. In yet another embodiment, the ink image 110 may be cured by a UV source 145 to produce a final cured image 160.

Apparatus and systems in accordance with another embodiment may include a substrate or web translation speed adjustment system (not shown) for adjusting and/or controlling a print process speed. The web 112 speed may be adjusted to increase or decrease an amount of time between a start of re-flow at a re-flow zone of a heated re-flow member 107 and curing by applying UV radiation using UV source 145. A speed of web translation may be adjusted to improve line spread and/or drawback of jetted UV curable gel ink. For example, if observed line spread and/or drawback characteristics for a particular substrate are unacceptable, a web translation speed may be adjusted, e.g., increased or decreased, to modify a line spread and/or minimize or eliminate drawback. Web translation speed may be adjusted alone or in addition to adjusting a heated re-flow member temperature, and/or a UV source location with respect to a re-flow zone.

In methods, apparatus, and systems of an embodiment, the UV gel ink and/or jetted ink lines may be spread UV curable gel ink while, e.g., controlling an ink pile height, and/or achieving line spread that compensates for adjacent missing jets in a print head. Also, good ink drop positioning may be achieved, regardless of the type of substrate and/or how the substrate is treated, but an amount of heat transferred through a backside of a substrate depends on the thermal properties of the substrate, and a thickness of the substrate. In an embodiment, spreading may be automatically controlled for various substrate types, despite varying thermal properties for the substrate types.

An in-line sensor and/or imaging system such as a CCD array sensor for image analysis may be used to observe and/or measure line spread and/or drawback characteristics of a known target, analyze the measurement, and based on the results, save the temperature as a setpoint for the particular substrate used, or set the temperature of a re-flow member so that re-flow and/or cure are optimized per substrate type. Further, to enhance an efficiency of optimizing spreading for particular substrate types, a position and/or location of a UV source may be adjusted for specific media or substrate types. For example, the location at which cure occurs may be determined using the in-line sensor and/or imaging system, saved as a setpoint, and automatically used to achieve a desired drop spread for a particular substrate.

Modifying re-flow member temperature may be time-consuming. Accordingly, an approach to optimizing a re-flow member temperature and/or dwell set point for a particular substrate type may be to determine a workable re-flow member temperature range, and determine a most effective temperature or range of temperatures within the determined workable temperature range by adjusting the UV source location, and hence dwell. This process may be less time-consuming than relying solely on adjusting a re-flow member temperature.

Figure 2:
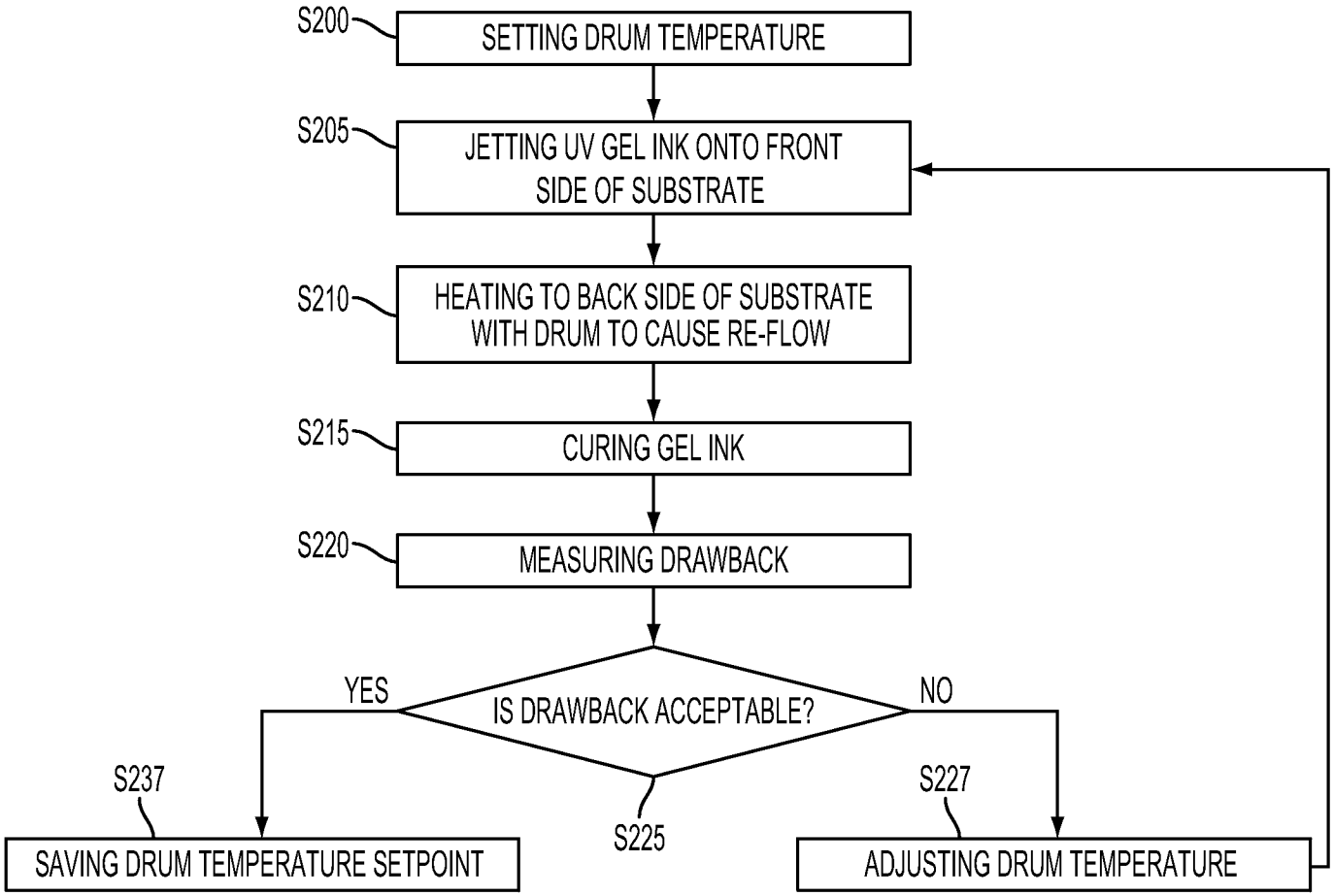
FIG. 2 shows UV gel ink re-flow temperature setpoint determination and adjustment processes in accordance with an exemplary embodiment.

As shown in FIG. 2, methods in accordance with an embodiment may include a step S200 of setting a drum temperature, i.e., a re-flow member temperature. For example, if running a calibration process or test image for determining temperature setpoints for particular substrates, the drum temperature may be set at about 200° C. In an alternative embodiment, the drum temperature may be set according to a predetermined setpoint. At S205, UV gel ink may be deposited directly onto a substrate. Heat may be applied by a heated, temperature controlled re-flow member at S210 to a backside of the substrate. The heat may cause the ink to re-flow and spread. At S215, a UV source such as a UV lamp may be used to apply radiation to the UV gel ink to cure the ink. The ink may be cured before, during, or after drawback.

At S220, the drawback may be measured. If the drawback is acceptable, the temperature at which the re-flow member was set in S200 may be saved at S237 as a setpoint for the substrate used during the process. For example, if the drawback is within a target value, or is within a target range of values, the temperature may be saved as a setpoint at S237. If the measured drawback is not within a target value or range of values, or is otherwise unacceptable, the drum temperature may be adjusted at S227. The target value or range of values may be defined by, e.g., a measured width of an observed line of jetted ink droplets. The drum temperature may be automatically adjusted using, e.g., an algorithm such as a computer-run genetic algorithm.

Figure 3:
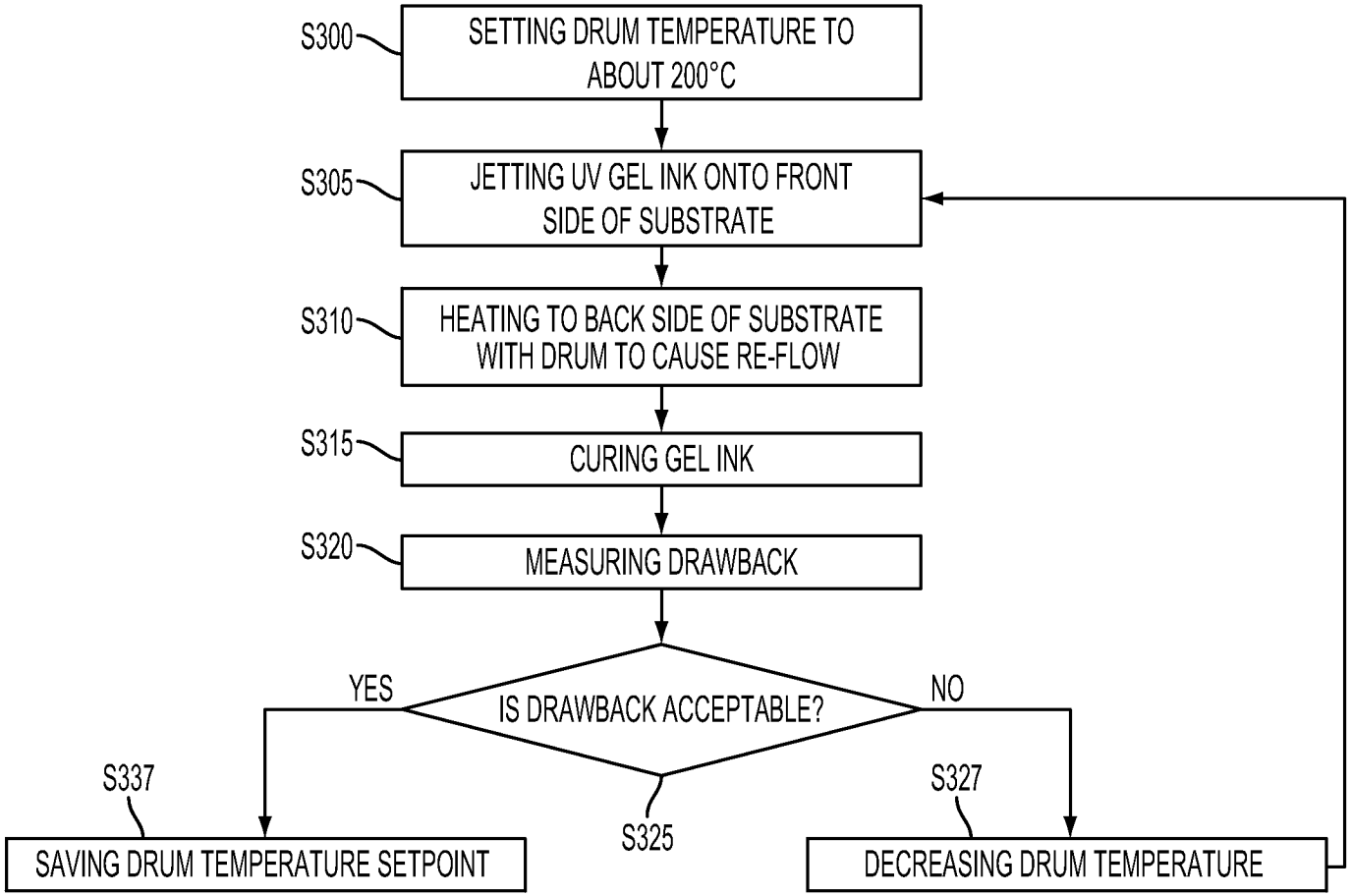
FIG. 3 shows UV gel ink re-flow temperature setpoint determination and adjustment processes in accordance with an exemplary embodiment.

Methods in accordance with another embodiment include adjusting the drum temperature by decreasing a drum temperature when a measured drawback is unacceptable. For example, FIG. 3 shows an embodiment of methods for calibrating a substrate type for digital printing processes using UV curable gel ink. At step S300, a temperature of a surface of a heated re-flow member may be set at 200° C. UV curable gel ink may be jetted onto a front side of a substrate at S305 to form an image. The substrate may be a media web, such as a paper web. The ink image may be carried by the web in a process direction to the heated re-flow member, which may be configured to entrain the web. The re-flow member may be configured to contact a back side of the web, and may be configured to heat the back side of the web to cause the ink on a corresponding front side portion of the web to re-flow.

Specifically, a back side of the substrate may be heated at S310 to cause re-flow of jetted UV gel ink as the ink passes through a re-flow zone. A re-flow zone may be defined by an area in which a portion of a re-flow member contacts a back side of a substrate, or conducts heat to a back side of a substrate whereby ink on a front side of the substrate is caused to re-flow. A UV source may be positioned near or at the re-flow zone for curing the gel ink at S315, and may be positioned to prevent or minimize drawback.

A drawback or drawback characteristics of the cured ink may be measured at S320. For example, the drawback may be measured using an in-line sensor and/or imaging system. The sensor may be used to generate data for determining an amount of drawback, which may be used to determine whether a particular observed drawback is acceptable, i.e., within desired parameters. Minimal drawback is preferred. Substantially no drawback is more preferred. At S325, the drawback measurement may be used to determine whether the drawback is acceptable. If the measured drawback is unacceptable, the drum temperature may be decreased at S327, and the process may continue at S305.

Alternatively, if the measured drawback is acceptable, the drum temperature set at S300 may be saved as a setpoint at S337. The setpoint saved at S337 may correspond to a particular substrate type on which the ink was deposited, and may be stored for later use. Setpoints may be determined and saved, for example, for a particular UV gel ink with respect to coated label stock, coated paper, transparency, and other substrate types. The setpoints may be used as needed in digital UV gel ink printing processes to efficiently and effectively accommodate different substrate types.

Figure 4:
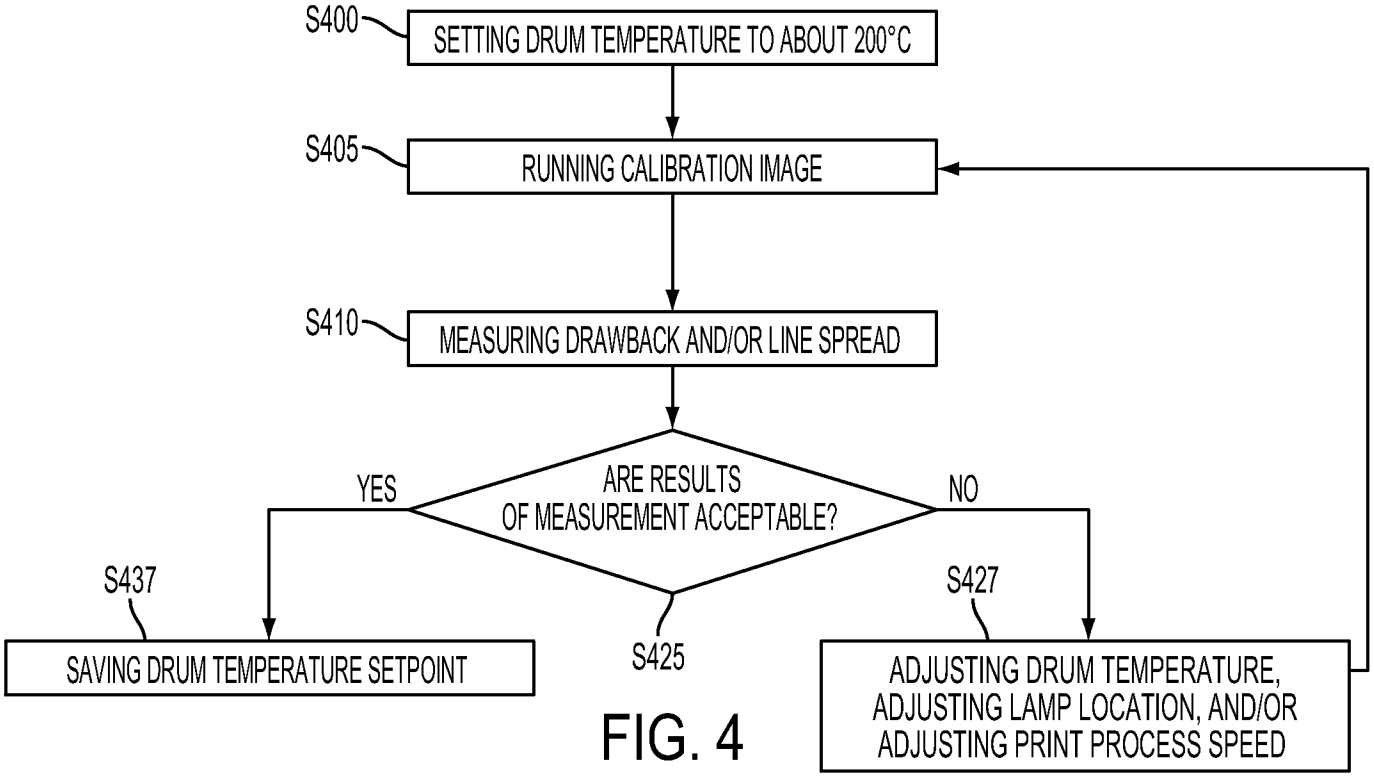
FIG. 4 shows UV gel ink re-flow and cure optimization processes in accordance with an embodiment.

In another embodiment, methods may include measuring at least one of drawback and line spread to calibrate for particular substrate types for use in digital UV curable gel ink printing processes. For example, FIG. 4 shows a step S400 of setting a re-flow member temperature, e.g., a heated rotatable drum entraining a media web, to about 200° C. A calibration image may be run at S405. Specifically, a test image may be formed by jetting UV gel ink on a substrate. The jetted ink that forms the image may be caused to re-flow by the heated drum. The ink may be cured by a UV source. The ink may be cured during re-flow to cause the ink to at least partially polymerized. For example, the ink may be cured to prevent or minimize drawback. At S410, at least one of drawback and line spread characteristics may be observed by, e.g., measuring an amount of line spread and/or drawback. For example, an imaging system may be used to determine a line width after re-flow and/or curing, and the observed line width may be compared with a target line width.

As shown in FIG. 4, the results of the measurements taken at S410 may be analyzed at step S425 to determine whether the drawback and/or line spread are acceptable. If the results of the measurements are unacceptable, at least one of the drum temperature, a UV source position, and a print process speed may be adjusted at S427 for achieving improved drawback and/or line spread. For example, the drum temperature may be adjusted based on a genetic algorithm. After adjusting the drum temperature at S427, another calibration image may be run at S405. Alternatively, if the results of the measurements are acceptable, the drum temperature used may be saved at S437.

In an embodiment, if a location of a UV source for curing re-flowed UV gel ink can be adjusted to improve line spread and/or drawback characteristics for a particular media type, in view of an observed and/or measured line spread and/or drawback, then the UV source location may be adjusted at S427, and the process continued from S405. If adjusting the location of the UV source would not have an appreciable effect, or would have only a negligible effect on line spread and/or drawback of jetted UV curable gel ink on a particular substrate type, then the UV source may not be adjusted, and the re-flow member temperature, for example, may be adjusted. UV source setpoints may also be saved, and used for automatically configuring a system to print on various substrate types.

In an embodiment, a speed of a print process may be adjusted at S427 to improve upon observed and/or measured line spread and/or drawback characteristics for a particular media type. Systems may be configured to determine whether such an adjustment would have more than a negligible effect on line spread and/or drawback before adjusting a print process speed. If the effect would be more than negligible, then a speed at which a substrate translates about a re-flow member during a print process may be increased or decreased. The nature and/or amount of speed adjustment may depend on observed and or measured line spread and/or drawback characteristics for a particular media type. Print process speed setpoints corresponding to particular media types may be saved and automatically implemented in printing processes as needed.

Figure 5:
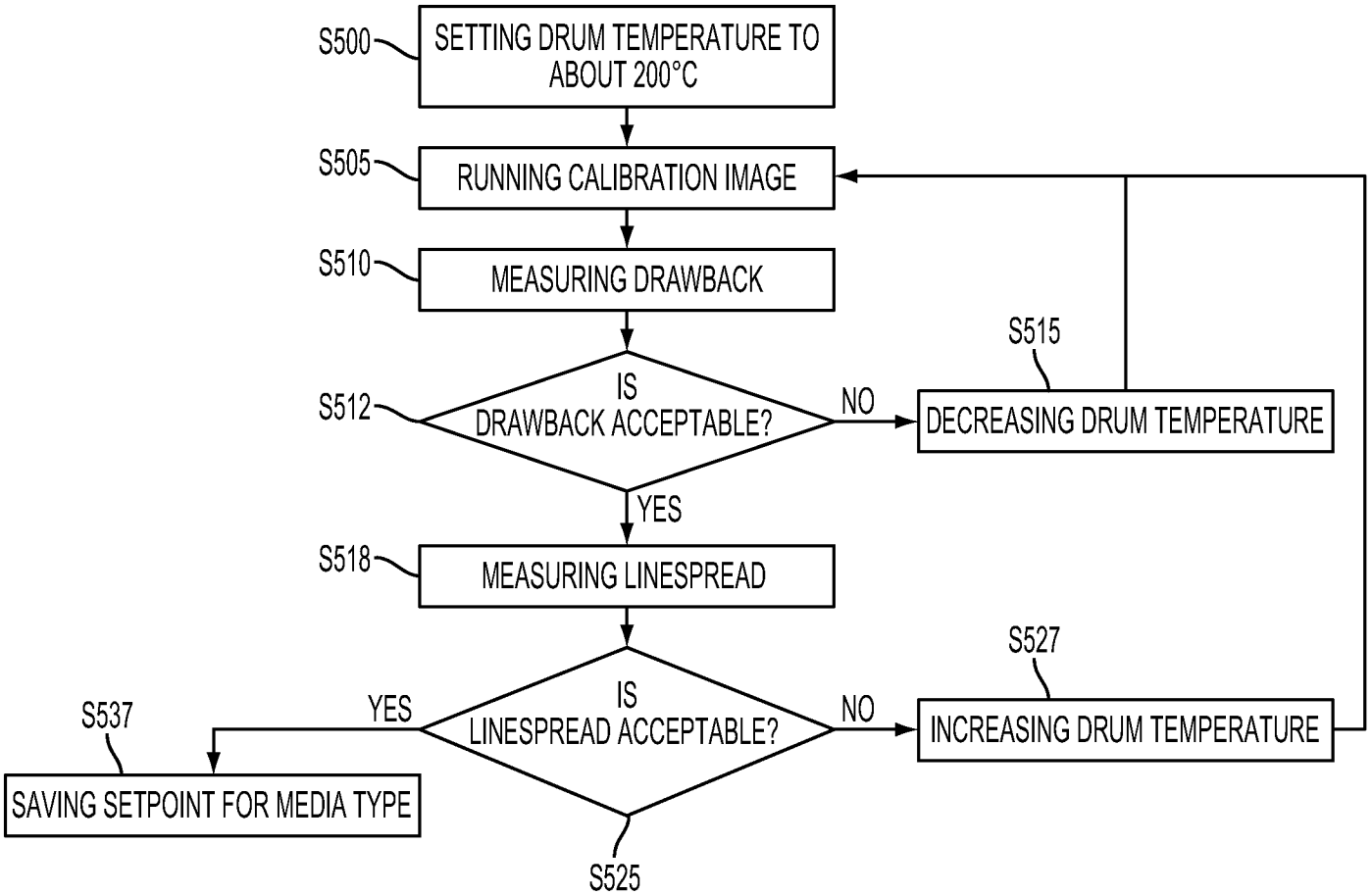
FIG. 5 shows UV gel ink spreading optimization processes in accordance with an embodiment.

As shown in FIG. 5, another embodiment of methods may include setting a drum temperature at about 200° C. at S500. At S505, a calibration image may be run by jetting UV gel ink onto a front side or image-bearing side of a substrate using an inkjet print head. The substrate may be entrained by a re-flow member that has a heated, temperature controlled surface that contacts a back side of the substrate during a print process. As the re-flow member contacts the back side of the media, heat from the re-flow member may be conducted through the substrate to the jetted ink, thereby causing the ink to re-flow. A UV source may be used to cure the ink during re-flow to stop or decrease flow of the ink and prevent or minimize drawback. The ink may be cured such that a small amount of the ink is polymerized thereby affecting flow of the ink. Alternatively, the ink may be cured by the UV source such that a substantial proportion of the re-flowed UV gel ink is polymerized. Alternatively, the ink may be cured to final cure state, or may be subject to a first preliminary cure, and a subsequent final cure.

A drawback of the re-flowed and cured UV gel ink may be measured at S510. For example, an in-line sensor may be used to observe drawback characteristics and produce drawback data. Drawback may be analyzed, e.g., by performing image analysis, to determine at S512 whether an observed drawback is acceptable, e.g., within a target drawback or drawback value or range. If the observed drawback is not acceptable, e.g., drawback is observed while no drawback is desired, a re-flow member temperature may be decreased at S515. An amount by which the temperature is caused to decrease may be determined using, e.g., a genetic algorithm. After the temperature is adjusted at S515, another calibration image may be run at S505.

Alternatively, if the drawback is determined to be acceptable at S512, line spread characteristics may be observed and/or measured at S518. If the line spread is unacceptable, then the re-flow member temperature may be increased at S527. For example, the re-flow member temperature may be increased by an amount determined using a genetic algorithm, and the process continued at S505. If the line spread is determined at S525 to be acceptable, the re-flow member temperature used to obtain the acceptable line spread may be saved as a setpoint at S537. The setpoint may correspond to a particular substrate type used.

Figure 6:
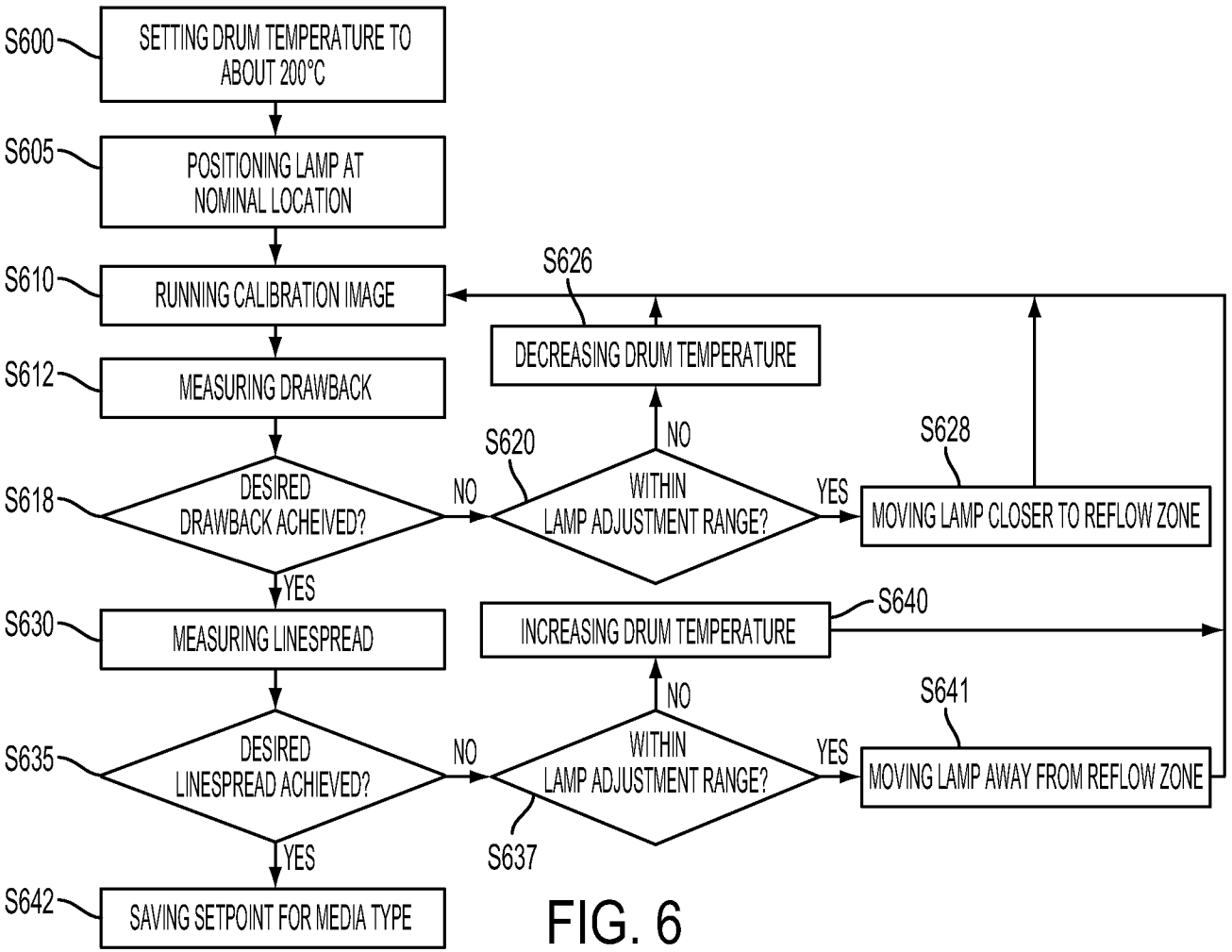
FIG. 6 shows UV gel ink spreading optimization processes in accordance with an embodiment.

In an embodiment, to enhance an efficiency of determining and/or optimizing temperature setpoints for substrate types, a location of a UV source may be adjusted to change a dwell time, i.e. a time between a start of gel ink re-flow and cure of the re-flowed gel ink. As shown in FIG. 6, methods in accordance with embodiments may include setting a re-flow member temperature, e.g., a drum temperature to about 200° C. at S600. A UV source for curing UV gel ink may be positioned at a nominal location at S605.

At S610, a calibration or test image print may be run. For example, UV curable gel ink may be jetted onto a substrate to form an uncured UV gel ink image. A backside of the substrate onto which the ink is jetted may be heated to cause the ink to re-flow. A UV source may be operably configured near a re-flow zone to cure the re-flowed ink. A drawback of the cured UV gel ink may be observed and/or measured using, e.g., an in-line sensor and/or imaging system at S612. For example, image analysis may be performed to observe and analyze drawback characteristics. At S618, the drawback data produced at S612 may be used to determined whether the measured or observed drawback is acceptable or within a target value or range. For example, it may be desirable to have no drawback. An image analysis may find that some drawback has occurred, and thus drawback is outside of a target value or range.

If the measured drawback is not acceptable, then at S620 it is determined whether the UV source is within a UV source adjustment range. For example, if moving a UV lamp would have an appreciable effect on the drawback or line spread, then the UV lamp may be in an adjustment range. If moving the UV lamp would not have an effect on an observed line spread and/or drawback, then the UV source is not in adjustment range, and other parameters may be adjusted to effect improved line spread and/or drawback, such as re-flow member temperature, and in an alternative embodiment, a print process speed.

If the UV source is not within an adjustment range, then a re-flow member or drum temperature may be decreased at S626. The amount of temperature decrease may be determined based on a genetic algorithm, for example. If the UV source is within an adjustment range, then the UV source may be moved to decrease an amount of time between a start of re-flow and applying of UV to the re-flowed ink for curing. After an adjustment made by way of either S626 or S628, another calibration image may be run at S610.

If the observed drawback is acceptable, then a line spread may be measured at S630. At S635, it may be determined whether the line spread is acceptable. For example, a line spread may be observed and/or measured to determine if a line width after re-flow and cure equals a target line width. If the line spread is not acceptable, then it may be determined at S637 whether the UV source is within an adjustment range, or whether movement of the UV source would have an effect on the line spread. If the UV source is not within a UV source adjustment range, then a re-flow member temperature may be increased at S640.

If the UV source is within a UV source or lamp adjustment range, then the location of the UV source may be adjusted at S641 to change the time between a start of re-flow and application of UV radiation to the re-flowed gel ink for curing. For example, the UV source may be moved away from a re-flow zone, or a point at which re-flow begins, at S641. After adjusting a UV source location, another calibration image may be run at S610.

Alternatively, if both the drawback is determined to be acceptable at S618, and the line spread is determined to acceptable at S635, then a setpoint may be saved at S642. For example, the setpoint may relate to lamp location data and temperature data for a particular substrate type. The temperature and/or lamp location data setpoint may correspond to, for example, a particular substrate type or treatment type, or combination of UV gel ink and substrate type. For example, a setpoint may correspond to coated label stock, coated paper, or transparency, among other substrate types.

In an alternative embodiment, a speed of a print process may be adjusted to improve upon observed and/or measured line spread and/or drawback characteristics for a particular media type. Systems may be configured to determine whether such an adjustment would have more than a negligible effect on line spread and/or drawback before adjusting a print process speed. If the effect would be more than negligible, then a speed at which a substrate translates about a re-flow member during a UV gel ink print process may be increased or decreased. The nature and/or amount of speed adjustment may depend on observed and or measured line spread and/or drawback characteristics for a particular media type. Print process speed setpoints corresponding to particular media types may be saved and automatically implemented in UV gel ink printing processes as needed.

While apparatus and systems for UV gel ink spreading are described in relationship to exemplary embodiments, many alternatives, modifications, and variations would be apparent to those skilled in the art. Accordingly, embodiments of methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various alternatives, modifications, variations or improvements therein may be subsequently made by those skilled in the art.

What is claimed is:

1. A UV gel ink spreading method, comprising:
jetting UV gel ink onto a substrate;
measuring an initial line width of a line of droplets of the jetted ink;
measuring a post re-flow line width of the line of jetted ink droplets;
setting a re-flow member temperature, the setting further comprising adjusting the re-flow member temperature to a temperature setpoint as a function of a comparison of the post re-flow line width and the initial line width;
heating a back side of the substrate whereby the jetted UV gel ink is heated and re-flows, the heating being performed by a heated drum; and
curing the UV gel ink before any pressure is applied to the heated ink.

2. The method of claim 1, comprising:
measuring a drawback;
analyzing a drawback measurement; and
saving a re-flow member temperature setpoint or adjusting a re-flow member temperature setpoint.

3. The method of claim 1, the setting further comprising setting the re-flow member temperature to approximately 200° C.

4. The method of claim 2, wherein the adjusting comprises decreasing the re-flow member temperature.

5. The method of claim 2, wherein the adjusting comprises increasing the re-flow member temperature.

6. The method of claim 1, comprising:
measuring a line spread.

7. The method of claim 6, the measuring a line spread comprising:
sensing the jetted and spread ink using an inline sensor for producing line spread data.

8. The method of claim 2, the measuring further comprising:
sensing the jetted and spread ink using an inline imaging system.

9. The method of claim 7, further comprising:
measuring a drawback;
sensing the jetted and spread ink using an inline sensor to produce drawback data;
analyzing drawback data to determine whether the drawback is within a target value or range;
analyzing the line spread data to determine whether the line spread is within target value or range;
saving a re-flow member temperature setpoint if the drawback is within the drawback target value or range, and if the line spread is within the line spread target value or range; and
adjusting a re-flow member temperature if at least one of the drawback and the line spread are outside of the target values or target ranges.

10. The method of claim 9, the adjusting further comprising:
decreasing the re-flow member temperature if the line spread is outside of the target value or target range.

11. The method of claim 9, the adjusting further comprising:
increasing the re-flow member temperature if the drawback is outside of the target value or range.

12. The method of claim 9, the adjusting further comprising:
adjusting a re-flow temperature if at least one of the drawback and the line spread are outside of a UV source adjustment range.

13. The method of claim 12, further comprising:

adjusting a UV source location if the drawback is outside the target range and within a UV source adjustment range, the adjusting including moving the UV source closer to a re-flow zone.

14. The method of claim 12, further comprising:

adjusting a UV source location if the line spread is within the target range and within a UV source adjustment range, the adjusting including moving the UV source away from a re-flow zone; and adjusting a print process speed to increase or decrease a speed at which a substrate translates if at least one of the drawback and line spread is outside of the target value or range, and outside of a UV source adjustment range.

15. A UV gel ink spreading apparatus, comprising:

an UV gel ink print head, for jetting UV ink onto a substrate;

a temperature controlled heated re-flow member for spreading gel ink deposited on a substrate by the UV gel ink print head;

a sensor that measures an initial line width of a line of droplets of the jetted ink, and measures a post re-flow line width of the line of jetted ink droplets;

a controller that compares the post re-flow line width to the initial line width, and sets a re-flow member temperature to a temperature setpoint as a function of the comparison of the post re-flow line width and the initial line width; and a UV source that cures the UV gel ink before any pressure is applied to the heated ink.

16. The apparatus of claim 15, wherein the controller that sets a temperature of the re-flow member based on at least one of a plurality of temperature setpoints that each correspond to a substrate type, the setpoints being defined by optimizing at least one of a location of the UV source and the re-flow member temperature based on data received from the sensor.

17. The apparatus of claim 16, comprising:

a print process speed adjustment system that adjusts a substrate translation speed, wherein the UV source is movable.

18. A UV gel ink spreading system, comprising:

a print head that deposits UV gel ink on a substrate;

a temperature controlled, heated re-flow member that spreads the UV gel ink on the substrate at a re-flow zone;

a sensor that senses the spread UV gel ink, and that generates data for analyzing line spread or drawback of the UV gel ink deposited by the print head;

a controller that adjusts a temperature of the re-flow member based on the data generated by the sensor;

a storage unit that stores a temperature set point based on data generated by the sensor, the temperature setpoint corresponding to a substrate type; and a UV source that cures the UV gel ink deposited by the print head and spread by the heated re-flow member before any pressure is applied to the heated ink.

19. The system of claim 18, comprising:

a print process speed control system that adjusts a print process speed, wherein the UV source is movable with respect to the re-flow zone.

* * * * *